US008807731B2

(12) United States Patent
Takeuchi et al.

(10) Patent No.: US 8,807,731 B2
(45) Date of Patent: Aug. 19, 2014

(54) INKJET IMAGE FORMING APPARATUS AND INKJET IMAGE FORMING METHOD

(75) Inventors: Noriyasu Takeuchi, Kawasaki (JP); Tamotsu Aruga, Atsugi (JP); Eiji Noda, Yokohama (JP); Shin-ya Seno, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 424 days.

(21) Appl. No.: 13/117,548

(22) Filed: May 27, 2011

(65) Prior Publication Data

US 2011/0298876 A1 Dec. 8, 2011

(30) Foreign Application Priority Data

Jun. 2, 2010 (JP) ..... 2010-127192

(51) Int. Cl.
*B41J 2/01* (2006.01)

(52) U.S. Cl.
USPC ..... 347/102; 347/101; 347/100

(58) Field of Classification Search
USPC ..... 347/16, 100–102
See application file for complete search history.

(56) References Cited

U.S. PATENT DOCUMENTS

| | | | | |
|---|---|---|---|---|
| 4,554,555 | A | 11/1985 | Aruga et al. | |
| 4,581,071 | A | 4/1986 | Akutsu et al. | |
| 4,620,876 | A | 11/1986 | Fujii et al. | |
| 4,631,085 | A | 12/1986 | Kawanishi et al. | |
| 4,647,310 | A | 3/1987 | Shimada et al. | |
| 4,711,668 | A | 12/1987 | Shimada et al. | |
| 4,713,113 | A | 12/1987 | Shimada et al. | |
| 4,737,190 | A | 4/1988 | Shimada et al. | |
| 4,793,860 | A | 12/1988 | Murakami et al. | |
| 7,919,544 | B2 | 4/2011 | Matsuyama et al. | |
| 7,950,793 | B2 | 5/2011 | Aruga et al. | |
| 2006/0023026 | A1* | 2/2006 | Hoshino | 347/43 |
| 2006/0050122 | A1* | 3/2006 | Nakano et al. | 347/102 |
| 2007/0197685 | A1 | 8/2007 | Aruga et al. | |
| 2007/0296790 | A1* | 12/2007 | Nakazawa et al. | 347/102 |
| 2008/0311299 | A1* | 12/2008 | Furukawa | 427/261 |
| 2009/0162569 | A1 | 6/2009 | Morohoshi et al. | |
| 2009/0239044 | A1 | 9/2009 | Habashi et al. | |
| 2010/0196601 | A1 | 8/2010 | Goto et al. | |
| 2010/0196602 | A1 | 8/2010 | Koyano et al. | |

* cited by examiner

*Primary Examiner* — Sarah Al Hashimi
(74) *Attorney, Agent, or Firm* — Oblon, Spivak, McClelland, Maier & Neustadt, L.L.P.

(57) ABSTRACT

An image recording apparatus is provided containing:

a recording medium conveying unit configured to convey a recording medium, a unit for adding a curable pre-treatment agent comprising a light curable non-colored material to the recording medium, at least one ink discharging unit configured to generate an image pattern by discharge of at least one inkjet ink, wherein the discharging is performed after the pre-treatment agent is charged to the recording medium, wherein the at least one inkjet ink comprises a light curable material and a colorant, and at least one light irradiation unit configured to irradiate the discharged inkjet ink to cure the at least one inkjet ink, without curing the pre-treatment agent, and after curing the at least one inkjet ink, the light irradiation unit cures the curable pre-treatment agent;

and an image recording method using the same.

8 Claims, 9 Drawing Sheets

WAVELENGTH OF HIGH PRESSURE MERCURY LAMP (USHIO HP DATE)

INKJET IMAGE FORMING APPARATUS AND INKJET IMAGE FORMING METHOD

CROSS-REFERENCE TO RELATED APPLICATIONS

The present application claims priority to Japan patent application JP2010-127192, filed on Jun. 2, 2010, the entire contents of which are hereby incorporated by reference in its entirety.

BACKGROUND OF THE INVENTION

1. Field of the Information

The present invention relates to an inkjet image forming apparatus and inkjet image forming method.

2. Discussion of the Background

Inkjet recording technique is a technique, and the technique made a ink to liquid spot by using a pressure ondemand form and a charge control form, and adheres the ink on a recording medium such as paper according to a image information.

The inkjet recording technique is preferably used in image forming apparatus such as printers, facsimiles, and copiers.

The inkjet recording technology can record ink to a recording medium using a simpler apparatus, as compared to indirect recording techniques, such as electrophotography using a photoconductor, because the inkjet recording process can adhere the ink to the recording medium directly, and is expected to increase in use in the future.

Inkjet recording is a process using a low noise printer system, and discharging ink on a recording medium, such as paper, cloth, or plastic sheet. The main use is for directly printing letters and images. Further, inkjet recording does not need a printing master, and can efficiently print even one or a few prints, so is excepted from industrial use.

However, industrial recording has to form images on various kinds of recording media, but direct discharge types of recording cannot satisfy the requirements. Accordingly, inkjet recording by direct discharge is an image forming method that has significant restrictions in the type of image medium that can be used.

One of the concrete restrictions is the ability of the recording medium to absorb ink. Most ink components are liquid, so differences in absorption permeability of the ink can have an influence on image reproducibility. In particular, while using a recording medium that does not absorb liquid ink, adjacent ink spots often are found to mix, resulting in a phenomenon where the first formed ink spots can be drawn to mix with later formed ink spots. Therefore, image recording is very difficult, and permeation drying can't be used, making high speed printing very difficult. An alternative to printing methods using recording media that do not absorb ink is a method using an ink containing an ultraviolet curing resin, which is cured by ultraviolet irradiation.

For example, JP2004-42548 describes a method using ultraviolet curing type ink, and matches the application of ultraviolet irradiation with the timing of the discharge of a dot of ultraviolet curing type color ink to the recording medium, causing a rise in viscosity by pre-curing to a level such that neighboring dots are not mixed with each other, and then further irradiating with ultraviolet irradiation to complete curing.

JP2004-42525 describes a technology to improve the visibility of colored ink, reduce bleeding, and reduce the difference between images on various recording media. The method uses a radiation curing type white ink that is coated homogeneously as an under layer. The ink is then cured, to increase viscosity, by irradiation, and inkjet recording is carried out using the radiation curing type color ink set.

However, while the method of JP2004-42548 is reported to control bleeding, there remains the problem of differences between recorded images on various recording media, insufficient homogeneity and color unevenness, and the like, of line width cause by mixing between liquid particles. Further, the method of JP2004-42525 also provides insufficient homogeneity and color unevenness, and the like, of line width caused by mixing between liquid particles.

One possible solution that has been proposed is as follows; an ultraviolet radiation curing type clear liquid is coated on the recording medium as an under layer, and colored ink is discharged, to prevent bleeding and mixing between liquid particles. For example, JP2008-105382 is one such proposal. JP2008-105382 describes a method that can form high quality images. However, according to the invention of JP2008-105382, the invention prevents too much extending of ink particles, but it is difficult to achieve conditions sufficient for pre-curing. This results in unevenness, due to the presence of incompletely cured and nearly uncured particles, and the unevenness makes deference of extending of each particles.

To avoid the problem, a technology is considered that discharges ink to an uncured layer, then discharged ink penetrates the surface of the uncured under layer, but the ink particles are not confined by influence of the under layer and bleeding occurs due to the ink particles spreading slowly. However, ink spreading is dependent on time. If there is a time gap between discharge and curing of the particles, there is a problem that the time gap creates a gap of ink particle size.

The present invention aims to solve the above-mentioned problems.

BRIEF SUMMARY OF THE INVENTION

Accordingly, one object of the present invention is to provide an inkjet image forming method, which uses a recording medium that does not absorb ink, and prevents a reduction of image quality caused by a time gap between ink discharge and curing of the ink particles, and can record high quality images.

A further object of the present invention is to provide an inkjet image forming apparatus for performing the above noted method.

These and other objects of the present invention, individually or in combinations thereof, have been satisfied by the discovery of an image recording apparatus comprising:

a recording medium conveying unit configured to convey a recording medium, a unit for adding a curable pre-treatment agent comprising a light curable non-colored material to the recording medium, at least one ink discharging unit configured to generate an image pattern by discharge of an inkjet ink, wherein the discharging is performed after the pre-treatment agent is charged to the recording medium, wherein the inkjet ink comprises a light curable material and a colorant, at least one light irradiation unit configured to irradiate the discharged inkjet ink to cure the inkjet ink, without curing the pre-treatment agent, and after curing the inkjet ink, the light irradiation unit cures the curable pre-treatment agent;

and an image forming method using such an apparatus.

BRIEF DESCRIPTION OF DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1A:
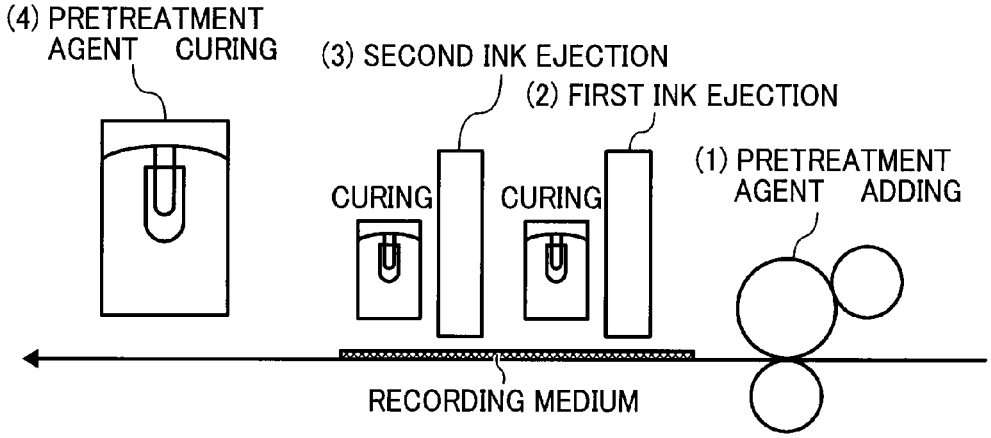
FIG. 1A is schematic view showing one embodiment of the image recording method of the present invention.

The present invention relates to an inkjet image forming apparatus and an inkjet image forming method.

In a first embodiment, the present invention provides an image recording apparatus comprising:

a recording medium conveying unit configured to convey a recording medium, a unit for adding a curable pre-treatment agent comprising a light curable non-colored material to the recording medium, at least one ink discharging unit configured to generate an image pattern by discharge of an inkjet ink, wherein the discharging is performed after the pre-treatment agent is charged to the recording medium, wherein the inkjet ink comprises a light curable material and a colorant, at least one light irradiation unit configured to irradiate the discharged inkjet ink to cure the inkjet ink, without curing the pre-treatment agent, and after curing the inkjet ink, the light irradiation unit cures the curable pre-treatment agent.

The at least one light irradiation unit is preferably an LED light source. In the present invention, the at least one light irradiation unit provides at least two separate functions: curing of the inkjet ink and curing of the curable pre-treatment agent. While it is possible to use the same light irradiation unit to perform both functions, it is preferred that separate light irradiation units be used for each function, in order to match the wavelength with that needed to cure either the inkjet ink or the curable pre-treatment agent.

It is particularly preferred that the light irradiation unit emit light at a wavelength that either (i) cures the inkjet ink but not the curable pre-treatment agent, or (ii) cures the curable pre-treatment agent selectively.

The wavelength range of the light irradiation unit can also be adjusted by the use of an appropriate filter.

Moreover, a preferred embodiment of the present invention provides the image recording apparatus, wherein the ink discharging unit is an inkjet linehead nozzle, wherein the linehead nozzle is positioned transversely to the direction in which the recording medium is being conveyed. In a most preferred embodiment, there are a plurality of such inkjet linehead nozzles (one for each color of ink), and an equal number of light irradiation units that irradiate at a wavelength that will cure the inkjet ink, but will not cure the curable pre-treatment agent. The inkjet linehead nozzles and light irradiation units for curing the inkjet ink are arranged in an alternating arrangement, so as to apply ink, cure ink, apply ink, cure ink, etc. In this embodiment, there is a final light irradiation unit located downstream of the final light irradiation unit for curing the inkjet ink, wherein the final light irradiation unit is for curing the curable pre-treatment agent.

In a further embodiment, the present invention provides the image recording apparatus, wherein the ink discharging unit is a serial inkjet head which forms the image by moving the head back and forth across the recording medium in a direction transverse to the direction in which the recording medium is being conveyed. In this embodiment, the light irradiation unit for curing the inkjet ink is preferably a single light irradiation unit located downstream of the serial inkjet head. A final light irradiation unit is located further downstream for curing the curable pre-treatment agent.

The present invention also relates to an image recording method, comprising:

(i) adding a curable pre-treatment agent comprising a curable non-colored material to a surface of a recording medium, (ii) discharging at least one curable inkjet ink to the surface of the recording medium to form an image, (iii) curing the at least one curable inkjet ink by irradiation with at least one light irradiation unit at a wavelength that cures the at least one curable inkjet ink but does not cure the curable pre-treatment agent; and (iv) curing the curable pre-treatment agent by irradiation with a light irradiation unit at a wavelength that cures the curable pre-treatment agent.

The curable pre-treatment agent can be applied to a portion of the recording medium surface or to the entire recording medium surface. When applied to just a portion of the recording medium surface, it is preferred that the curable pre-treatment agent be applied to the image forming area of the surface.

When the image is a single color image, the steps (ii) and (iii) are performed once. In a multi-color image when multiple inkjet heads are used to apply the inkjet ink, the steps (ii) and (iii) are sequentially performed multiple times (once for each color of ink being applied; i.e. for each inkjet head). If all colors of ink are being applied at once such as with a serial inkjet head, steps (ii) and (iii) are preferably performed just once.

In a preferred embodiment, wherein multiple inkjet inks are being applied by multiple inkjet heads, the method of the present invention further comprises applying the curable pre-treatment agent followed by moving the recording medium a distance to a position of the first inkjet head. After application of the first inkjet ink, and subsequent light irradiation to cure the inkjet ink (but not the curable pre-treatment agent), the recording medium is moved a distance to position the ink application area at the second inkjet head, and so forth until all inkjet ink has been applied for the given image. The recording medium is then moved to position for light irradiation by the final light irradiation unit which cures the curable pre-treatment agent.

Figure 1B:
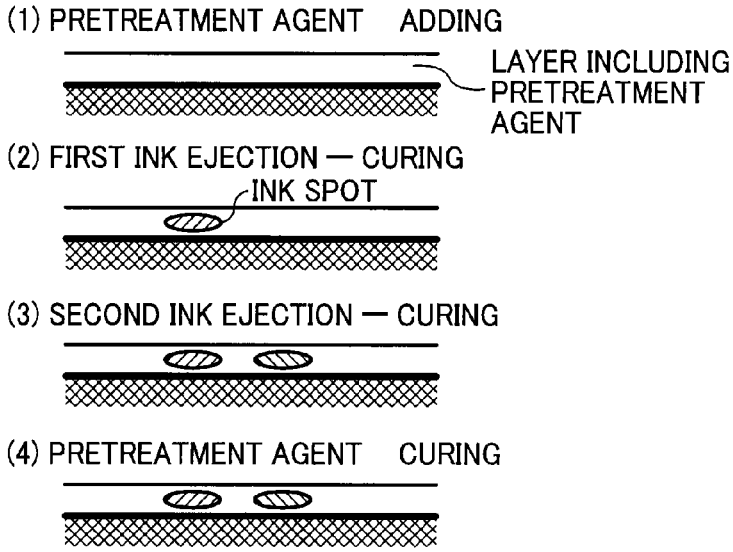
FIG. 1B is a graphical representation showing one embodiment of the image recording method of the present invention.

In the FIGS. 1A and 1B, image forming methods are shown by way of illustration to describe the present invention.

FIG. 1A is a schematic showing an embodiment of the apparatus of the present invention. FIG. 1B is a schematic showing each step in an embodiment of the method of the present invention in order. Recording medium is conveyed from a feed unit to a curable pre-treatment agent adding unit. The curable pre-treatment agent is added to a surface of the recording medium, followed by discharging of the inkjet ink onto the recording medium to form the image. The light irradiation unit then cures the inkjet ink, but not the curable pre-treatment agent. Following movement of the recording medium to place the image forming area beneath the second ink injection unit, the second inkjet ink is then discharged to the recording medium, and the second light irradiation unit cures the second inkjet ink. The recording medium is then moved to position for irradiation by the light irradiation unit for curing the curable pre-treatment agent.

After each ink is discharged, the ink is cured within a suitable time to prevent excessive extension of the ink particle. This permits the production of high quality images where the final image pixel size is essentially the same size as the spot formed by the initial application of the ink.

Figure 1C:
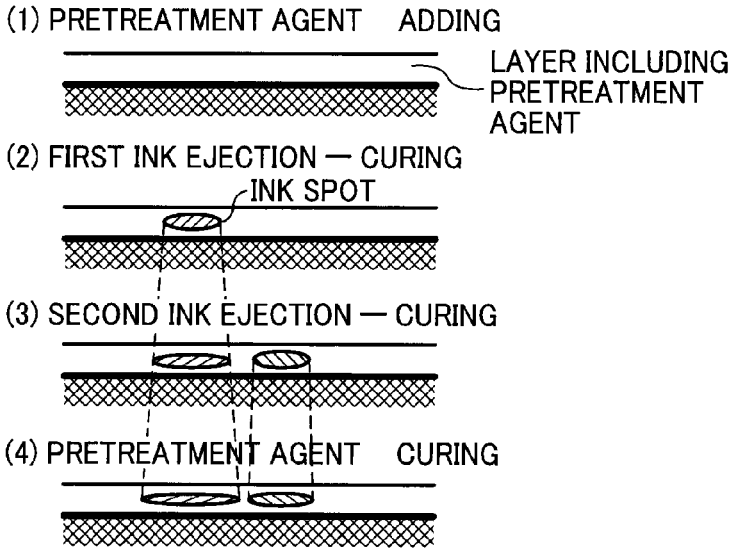
FIG. 1C is a graphical representation showing one example a conventional image recording method.

The conventional method is illustrated in FIG. 1C, whereby all inks are discharged prior to any curing of the inks. This results in the time between discharge and curing being different for the various inks applied, resulting in heterogeneity of pixel size due to different amounts of time for the different inks to spread between discharge and curing, giving a large difference in the level of expanding of ink particles.

In the present invention, since each ink is cured immediately after discharge to the recording medium, it is not necessary to cure each ink completely, but rather each should be cured just enough to increase the viscosity of the ink-spot sufficiently to prevent excessive spreading.

When the amount of light applied by the light irradiation unit is small, the outer portion of the ink particles can cure, while leaving the center of the ink particles un-cured. However, even in this situation, the present invention prevents expanding of the ink particles.

The light irradiation unit which cures the curable pre-treatment agent, can optionally include the ability to additionally irradiate at wavelengths suitable for curing the inkjet ink. In such a situation, any incompletely cured ink particles will be completely cured by the final light irradiation unit at the same time that the curable pre-treatment agent is being cured. Further, using such a light irradiation unit permits the final ink curing after last ink discharge to occur at the same time as curing of the curable pre-treatment agent.

Figure 2:
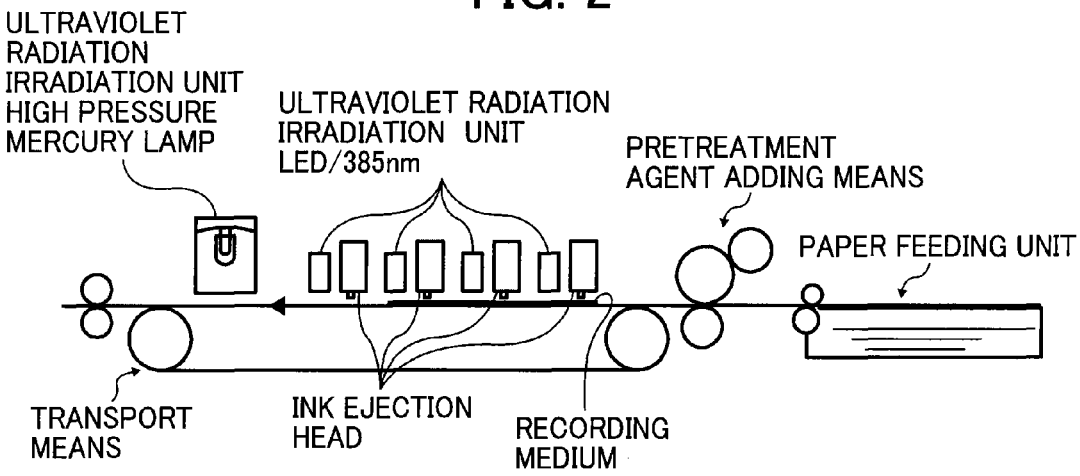
FIG. 2 is schematic view showing one embodiment of the image recording apparatus of the present invention.

FIG. 2 is a schematic view showing one embodiment of an image forming apparatus of the present invention. In this embodiment, a recording medium is conveyed from a feed unit to a curable pre-treatment agent adding unit, whereby the pre-treatment agent is thinly coated on at least a portion of the surface of the recording medium. The recording medium is then conveyed to an image forming unit, in which the inkjet ink is discharged from the ink discharging head in accordance with the image desired.

The inkjet ink (comprising at least a light curable material and a colorant) are supplied from an ink reservoir (not shown) to the ink charging head as needed for the image desired. After discharge to the recording medium, the ink is cured by a light irradiating unit which is configured to emit radiation at a wavelength capable of curing the inkjet ink, but not the curable pre-treatment agent. Therefore, the curable pre-treatment agent is kept in an uncured status. In embodiments where there are two or more inks are being applied by separate ink discharge units, the apparatus preferably includes a light irradiation unit for each ink discharge unit. For example, if the printing is full color, the light irradiation unit is located adjacent to the ink charging unit, because the four inks, which are yellow, magenta, cyan, and black, are each charged individually in turn, and each ink is cured directly after discharge to the medium and prior to application of the next ink. In this way, each ink may be cured in the same elapsed time from discharge to cure. After all of the ink has been discharged to the recording medium, the curable pre-treatment agent is cured by a light irradiating unit. This light irradiating unit for curing the curable pre-treatment agent may be a separate final light irradiating unit, or may be the same unit as the final light irradiating unit used to cure the final ink that is applied.

FIGS. 3A to 3D provide absorption spectra of various photoinitiators which can be contained in the curable pre-treatment agent and/or colorant inks for use in the present invention. For the curable pre-treatment agent, it is preferred to use a photoinitiator having an absorption wavelength less than 350 nm. For the colorant inkjet ink, it is preferred to use a photoinitiator having an absorption wavelength around 400 nm.

For example, IRGACURE 184 (manufactured by Ciba-Geigy Ltd. see FIG. 3A) is preferably used as a photoinitiator for the curable pre-treatment agent, and IRGACURE 369 (manufactured by Ciba-Geigy Ltd. see FIG. 3B) is preferably used as a photoinitiator for the colorant inkjet ink.

Figure 3A:
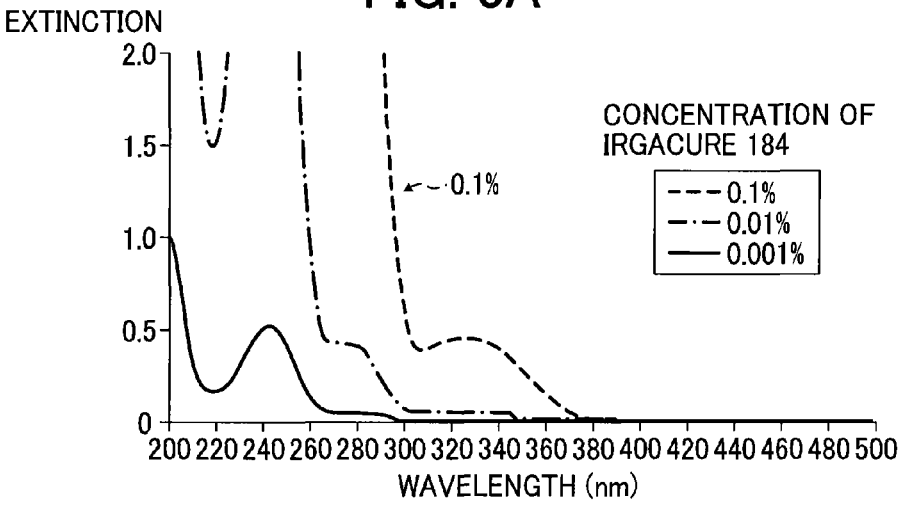
FIG. 3A is a graph showing absorption characteristics of IRGACURE 184 (manufactured by Ciba-Geigy Ltd.).
Figure 3B:
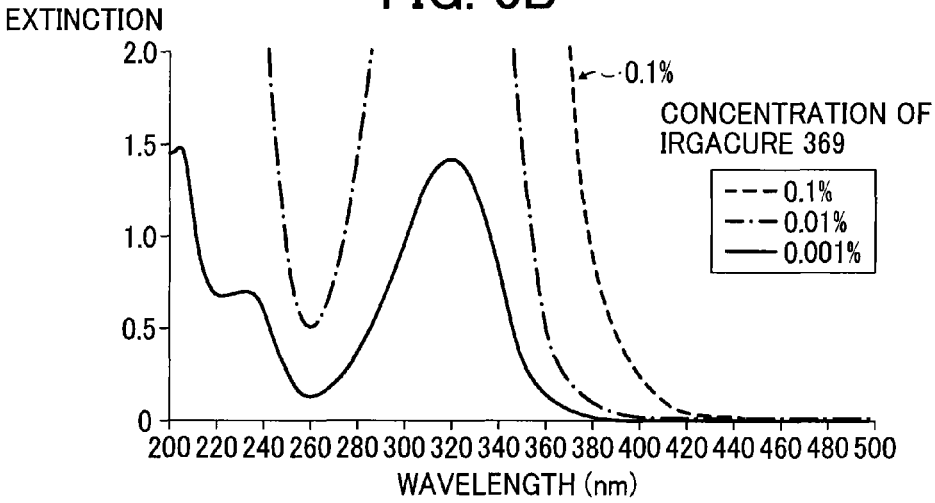
FIG. 3B is a graph showing absorption characteristics of IRGACURE 369 (manufactured by Ciba-Geigy Ltd.).
Figure 3C:
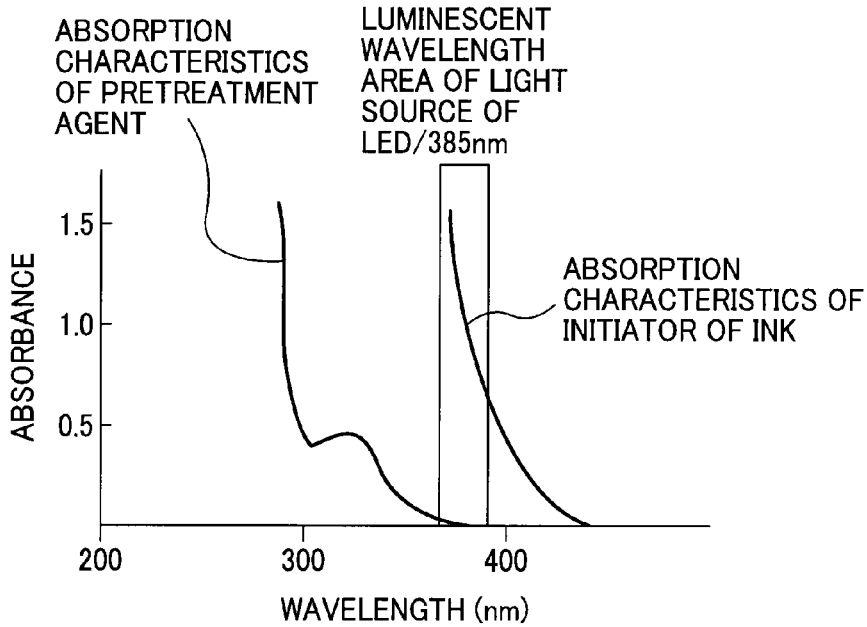
FIG. 3C is a graph showing absorption characteristics of a curing initiator and absorption characteristics of a pretreatment agent of the present invention and the relationship with the luminescent wavelength area of an LED light source at 385 nm.
Figure 3D:
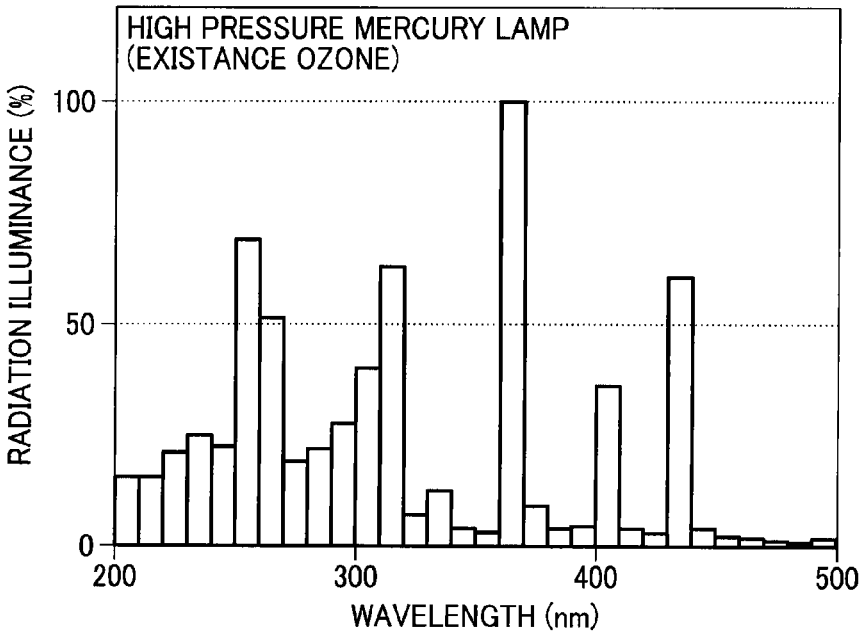
FIG. 3D is a graph showing output wavelengths of a high pressure mercury lamp.

When an LED light source of wavelength 385 nm is used for curing the colored inkjet ink only, the curable pre-treatment agent is not cured because the absorption wavelength of curable pre-treatment agent is different from the absorption wavelength of the colored inkjet ink (See FIG. 3C).

After all of the inkjet inks have been discharged to the medium and cured, the pre-treatment agent is then cured, preferably using a light source that irradiates a wide range of wavelengths, such as a high pressure mercury lamp, to cure the pre-treatment agent and complete curing of the inkjet inks if needed. (see FIG. 3D).

Using the method of the present invention, a high quality image can be achieved, having a substantially homogeneous level of dot diameters.

The inkjet ink of the present invention comprises at least a polymerizable compound, a photoinitiator, and preferably a colorant (except in clear non-colored inks) as main components. Optional components that may be used include, but are not limited to, leveling agents, reaction accelerators, reaction prohibitants, and sensitizers.

The colorant used in the inkjet ink may be suitably selected in accordance with the intended use. Examples of the colorant include, but are not limited by, well known water-soluble dyes, oil-soluble dyes, and pigments.

An ultraviolet curable ink is typically classified into two types: radical polymerizable ink or cationic polymerizable ink. The radical polymerizable ink includes radical polymerizable compounds, and the cationic polymerizable ink includes cationic polymerizable compounds. Each type of ink may be used individually, or in mixtures of two or more. Further, in the present invention, a clear ink having no colorant can be used, and colored ink having a colorant such as black, cyan, magenta, or yellow are preferably used. Light colored ink, for example, white ink, and the like, may also be used to provide different shades of colors and richly graded colors.

Examples of the epoxy compound to apply to cationic polymerization type ink include, but are not limited to, bisphenol A containing epoxy compounds, bisphenol BA containing epoxy compounds, bisphenol F containing epoxy compounds, bisphenol AD containing epoxy compounds, phenol novolac epoxy compounds, cresol novolac epoxy compounds, alicyclic epoxy compound, fluorine containing epoxy compounds, naphthalene containing epoxy compounds, glycidyl ester compounds, glycidyl amine compounds, heterocyclic epoxy compounds, and α-olefin epoxy compounds.

Alicyclic epoxy compounds are preferred, because their viscosity is low and curing speed is fast. Examples of the alicyclic epoxy compounds include 3,4-epoxycyclohexenylmethyl-3',4'-epoxycyclohexenecarboxylate, ε-caprolactone denaturation compound of 3,4-epoxycyclohexenylmethyl-3',4'-epoxycyclohexenecarboxylate, bis-(3,4-epoxy cyclohexylmethyl)adipate, 1,2:8,9-diepoxylimonene, vinylcyclohexenemonooxide, and 2-epoxy-4-vinylcyclohexane.

The oxethane compounds useful for the cationic polymerizable ink may be suitably selected in accordance with the properties required of the ink. In particular, if the adhesion to base is important, 3-ethyl-3-(phenoxymethyl)oxetane is preferred.

A vinyl ether compound may be mixed with the cationic polymerizable ink if necessary. Example of suitable vinyl ether compounds include, but are not limited to, 2-ethylhexylvinylether, butanediol-1,4-divinyl ether, cyclohexanedimethanol monovinyl ether, diethylene glycol monovinyl ether, diethylene glycol monovinyl ether, diethylene glycol divinyl ether, dipropylene glycol divinyl ether, dodecyl vinyl ether, ethylvinyl ether, hexanediol divinyl ether, hydroxy butyl vinyl ether, hydroxyethyl vinyl ether, isobutyl vinyl ether, methyl vinyl ether, octadecyl vinyl ether, propyl vinyl ether, triethylene glycol divinyl ether, vinyl-4-hydroxy butyl ether, vinyl cyclohexyl ether, vinyl propionate, vinyl carbazole, vinylpyrrolidone.

Propenyl ether and butenyl ether may be added as reactive components of the cationic polymerizable ink, if necessary.

Examples of the propenyl ether and butenyl ether include, but are not limited to, 1-dodecyl-1-propenylether, 1-dodecyl-1-butenylether, 1-butenoxymethyl-2-norbornene, 1-4-di (one-butenoxy) butane, 1,10-di(1-butenoxy) decane, 1,4-di (one-butenoxymethyl) cyclohexane, diethylene glycol di(1-butenyl)ether, 1,2,3-tri(1-butenoxy) propane, and propenyl ether propylene carbonate, and the like.

As compounds for use as the initiator in a cationic polyerizable ink, to be initiated by irradiation with UV light, arylsulfonium salts, such as onium salts, and aryl iodonium salts are preferred.

Further, a light sensitizer may be used in combination with the above cationic polymerization initiators, including, but not limited to, N-vinyl carbazoles, thioxanthone compounds, and 9,10-dibutoxy anthracene, if necessary.

Radical polymerizable monomers are preferred components of radical polymerizable inks. The radical polymerizable monomer may be polymerized by initiation radicals which are generated from a radical polymerization initiator.

Examples of the radical polymerizable monomers include, but are not limited to, (meth)acrylates, (meth)acrylamides, aromatic compounds, vinyl ethers, and compounds having internal double bonds (such as maleic acid).

Examples of the polymerizable compounds having either single functionality or multi functionality include, but are not limited to, the following:

Examples of single functional (meth)acrylates include, but are not limited to, hexyl(meth)acrylate, 2-ethyl hexyl (meth) acrylate, tert-octyl (meth)acrylate, isoamyl (meth)acrylate, decyl (meth)acrylate, isodecyl (meth)acrylate, stearyl (meth) acrylate, isostearyl (meth)acrylate, cyclohexyl (meth)acrylate, 4-n-butyl cyclohexyl (meth)acrylate, bornyl (meth)acrylate, isobornyl (meth)acrylate, benzyl (meth)acrylate, 2-ethyl hexyl diglycol (meth)acrylate, butoxy ethyl (meth)acrylate, 2-chloroethyl (meth)acrylate, 4-bromobutyl (meth)acrylate, cyanoethyl (meth)acrylate, buthoxymethyl (meth)acrylate, 3-methoxy butyl (meth)acrylate, alkoxymethyl (meth)acrylate, alkoxyethyl (meth)acrylate, 2-(2-methoxy ethoxy)ethyl (meth)acrylate, 2-(2-butoxy ethoxy)ethyl (meth)acrylate, 2,2,2-trifluoroethyl (meth)acrylate, 1H,1H,2H,2H-perfluorodecyl (meth)acrylate, 4-butylphenyl (meth)acrylate, phenyl (meth)acrylate, 1,2,4,5-tetramethylphenyl (meth)acrylate, 4-chlorophenyl (meth)acrylate, phenoxymethyl (meth) acrylate, phenoxyethyl (meth)acrylate, glycidyl (meth) acrylate, glycidyloxybutyl (meth)acrylate, glycidyloxyethyl (meth)acrylate, glycidyloxypropyl (meth)acrylate, tetrahydrofuryl (meth)acrylate, hydroxyalkyl (meth)acrylate, 2-hydroxyethyl (meth)acrylate, 3-hydroxypropyl (meth)acrylate, 2-hydroxypropyl (meth)acrylate, 2-hydroxybutyl (meth) acrylate, 4-hydroxybutyl (meth)acrylate, dimethylaminoethyl (meth)acrylate, diethylaminoethyl (meth)acrylate, dimethylaminopropyl (meth)acrylate, diethylaminopropyl (meth)acrylate, trimethoxysilylpropyl (meth)acrylate, trimethylsilylpropyl (meth)acrylate, polyethylene oxide monomethyl ether (meth)acrylate, oligoethyleneoxid monomethylether (meth)acrylate, polyethylene oxide (meth)acrylate, oligoethyleneoxid (meth)acrylate, oligoethyleneoxid monoalkylether (meth)acrylate, polyethylene oxide monoalkyl ether (meth)acrylate, dipropyleneglycol (meth) acrylate, polypropylene oxide monoalkyl ether (meth)acrylate, oligopropylene oxide monoalkyl ether (meth)acrylate, 2-methacryloxyethyl succinic acid, 2-methacryloxy hexahydrophthalic acid, 2-methacryloxy eth-2-hydroxypropyl phthalate, butoxy diethylene glycol (meth)acrylate, trifluoroethyl (meth)acrylate, perfluorooctylethyl (meth)acrylate, 2-hydroxy-3-phenoxypropyl (meth)acrylate, ethylene oxide denatured phenol (meth)acrylate, ethylene oxide denatured cresol (meth)acrylate, ethylene oxide denatured nonylphenol (meth)acrylate, propylene oxide denatured nonylphenol (meth)acrylate, propylene oxide denatured 2-ethylhexyl (meth)acrylate, and the like.

Examples of multifunctional (meth)acrylates that may be used in the present invention radical polymerizable ink include, but are not limited to, (meth)acrylic amide, N-methyl (meth)acrylic amide, N-ethyl (meth)acrylic amide, N-propyl (meth)acrylic amide, N-n-butyl (meth)acrylic amide, N-t-butyl (meth)acrylic amide, N-butoxymethyl (meth)acrylic amide, N-isopropyl (meth)acrylic amide, N-methylol (meth) acrylic amide, N,N-dimethyl (meth)acrylic amide, N,N-diethyl (meth)acrylic amide, and N-morpholino (meth)acrylic amide.

Examples of monofunctional aromatic vinyl compounds for use in the present invention radical polymerizable ink include, but are not limited to, styrene, methyl styrene, dimethyl styrene, trimethyl styrene, ethyl styrene, isopropyl styrene, chloromethyl styrene, methoxy styrene, acetoxy styrene, chlorostyrene, dichlorostyrene, bromostyrene, vinyl benzoic acid methyl ester, 3-methyl styrene, 4-methyl styrene, 3-ethyl styrene, 4-ethyl styrene, 3-propyl styrene, 4-propyl styrene, 3-butyl styrenes, 4-butyl styrenes, 3-hexyl styrene, 4-hexyl styrene, 3-octyl styrene, 4-octyl styrene, 3-(2-ethylhexyl) styrene, 4-(2-ethylhexyl) styrene, allyl styrene, isopropenyl styrene, butenyl styrene, octenyl styrene, 4-t-butoxycarbonyl styrene, 4-methoxy styrene, 4-t-butoxy styrene Examples of monofunctional vinylethers include, but are not limited to, methyl vinyl ether, ethyl vinyl ether, propyl vinyl ether, n-butyl vinyl ether, t-butyl vinyl ether, 2-ethyl hexyl vinyl ether, n-nonyl vinyl ether, lauryl vinyl ether, cyclohexyl vinyl ether, cyclohexyl methyl vinyl ether, 4-methyl(cyclohexyl)methyl vinyl ether, benzyl vinyl ether, dicyclopentenyl vinyl ether, 2-dicyclopentenoxyethyl vinyl ether, methoxyethyl vinyl ether, ethoxyethyl vinyl ether, butoxyethyl vinyl ether, methoxyethoxyethyl vinyl ether, ethoxyethoxyethyl vinyl ether, methoxy polyethylene glycol vinyl ether, tetrahydrofurfuryl vinyl ether, 2-hydroxyethyl vinyl ether, 2-hydroxypropyl vinyl ether, 4-hydroxy butyl vinyl ether, 4-hydroxymethyl(cyclohexyl)methyl vinyl ether, diethyleneglycol ethyl vinyl ether, polyethylene glycol vinyl ether, chloroethyl vinyl ether, chlorobutyl vinyl ether, chloroethoxyethyl vinyl ether, phenylethyl vinyl ether, and phenoxy polyethylene glycol vinyl ether.

Examples of difunctional (meth)acrylates include, but are not limited to, 1,6-hexanediol di(meth)acrylate, 1,10-decane diol di(meth)acrylate, neo-pentyl glycol di(meth)acrylate, 2,4-dimethyl-1,5-pentanediol di(meth)acrylate, butyl ethyl propanediol (meth)acrylate, ethoxycyclohexanemethanol di(meth)acrylate, polyethylene glycol di(meth)acrylate, oligo(ethylene glycol) di(meth)acrylate, ethylene glycol di(meth)acrylate, 2-ethyl-2-butyl-butanediol di(meth)acrylate, hydroxypivalic acid neo-pentyl glycol di(meth)acrylate, ethylene oxide denatured bisphenol A di(meth)acrylate, bisphenol F polyethoxy di(meth)acrylate, polypropylene glycol di(meth)acrylate, oligo(propyleneglycol) di(meth)acrylate, 1,4-butanediol di(meth)acrylate, 2-ethyl-2-butyl propanediol di(meth)acrylate, 1,9-nonane di(meth)acrylate, propoxyethoxy bisphenol A di(meth)acrylate, and tricyclodecane di(meth)acrylate.

Examples of trifunctional (meth)acrylates include, but are not limited to, trimethylolpropane tri(meth)acrylate, trimethylolethane tri(meth)acrylate, alkylene oxide denatured tri (meth)acrylate of a trimethylol propane, pentaerythritol tri (meth)acrylate, dipentaerythritol tri(meth)acrylate, trimethylolpropane tris[(meth)acryloyloxypropyl]ether, isocyanuric acid alkylene oxide denatured tri(meth)acrylate, propionic acid dipentaerythritol tri(meth)acrylate, tris [(meth)acryloyl oxyethyl]isocyanurate, hydroxy pivaldehyde denatured dimethylolpropane tri(meth)acrylate, sorbitol tri (meth)acrylate, propoxy trimethylolpropane tri(meth)acrylate, and ethoxy glycerin tri(meth)acrylate.

Examples of divinyl ethers usable in the present invention radical polymerizable ink include, but are not limited to, ethylene glycol divinyl ether, diethylene glycol divinyl ether, polyethylene glycol divinyl ether, propylene glycol divinyl ether, butylene glycol divinyl ether, hexanediol divinyl ether, bisphenol A alkylene oxide divinyl ether, and bisphenol F alkylene oxide divinyl ether.

Examples of multifunctional vinyl ethers include, but are not limited to, trimethylolethane trivinyl ether, trimethylolpropane trivinyl ether, di(trimethylolpropane) tetravinyl ether, glycerin trivinyl ether, pentaerythritol tetravinyl ether, dipentaerythritol pentavinyl ether, dipentaerythritol hexavinyl ether, ethylene oxide added trimethylolpropane trivinyl ether, propylene oxide added trimethylolpropane trivinyl ether, ethylene oxide added ditrimethylolpropane tetravinyl ether, propylene oxide added ditrimethylolpropane tetravinyl ether, ethylene oxide added pentaerythritol tetravinyl ether, propylene oxide added pentaerythritol tetravinyl ether, ethylene oxide added dipentaerythritol hexavinyl ether, propylene oxide added dipentaerythritol hexavinyl ether.

Divinyl ether compounds and trivinyl ether compounds are preferred from the viewpoint of hardening characteristics, coherency with a recording medium, and surface hardness of a formed picture, and divinyl ether compounds are particularly preferred.

In the ink compositions of the present invention, light curable resin monomers comprise 10-70 wt %. Resin monomers having an unsaturated radical polymerizable double bond in the molecular structure, are preferable. Examples of a light curable resin monomer having a single functional group include, but are not limited to, 2-ethylhexyl (meth) acrylate (EHA), 2-hydroxyethyl (meth)acrylate (HEA), 2-hydroxypropyl (meth)acrylate (HPA), caprolactone denatured tetorahydrofurfuryl (meth)acrylate, isobornyl (meth)acrylate, 3-methoxybutyl (meth)acrylate, tetrahydrofurfuryl (meth)acrylate, lauryl (meth)acrylate, 2-phenoxyethyl (meth)acrylate, isodecyl (meth)acrylate, isooctyl (meth)acrylate, tridecyl (meth)acrylate, caprolactone (meth)acrylate, and ethoxynonylphenol (meth)acrylate.

Examples of difunctional compounds include, but are not limited to, tripropylene glycol di(meth)acrylate, triethylene glycol di(meth)acrylate, tetraethylene glycol di(meth)acrylate, polypropylene glycol di(meth)acrylate, neopentylglycol hydroxypivalic acid ester di(meth)acrylate (MANDA), hydroxypivalic acid neo-pentyl glycol ester di(meth)acrylate (HPNDA), 1,3-butanediol di(meth)acrylate (BGDA), 1,4-butanediol di(meth)acrylate (BUDA), 1,6-hexanediol di(meth) acrylate (HDDA), 1,9-nonanediol di(meth)acrylate, diethylene glycol di(meth)acrylate (DEGDA), neo-pentyl glycol di(meth)acrylate (NPGDA), tripropylene glycol di(meth) acrylate (TPGDA), caprolactone denatured hydroxypivalic acid neo-pentyl glycol ester di(meth)acrylate, propoxy neopentylglycol di(meth)acrylate, ethoxy denatured bisphenol A di(meth)acrylate, polyethylene glycol 200 di(meth)acrylate, and polyethylene glycol 400 di(meth)acrylate.

Examples of multifunctional compounds include trimethylolpropane tri(meth)acrylate (TMPTA), pentaerythritol tri (meth)acrylate (PETA), dipentaerythritol hexa(meth)acrylate (DPHA), triallylisocyanate, (meth)acrylate of ϵ-caprolactone denatured dipentaerythritol, tris(2-hydroxyethyl) isocyanurate tri(meth)acrylate, ethoxy trimethylolpropane tri(meth) acrylate, propoxy trimethylolpropane tri(meth)acrylate, propoxy glyceryl tri(meth)acrylate, pentaerythritol tetra(meth) acrylate, di(trimethylolpropane) tetra(meth)acrylate, dipentaerythritol hydroxypenta(meth)acrylate, ethoxy pentaerythritol tetra(meth)acrylate, and penta(meth)acrylate ethoxy ester.

Examples of commercial products for use as light curable resin monomers include, but are not limited to, KAYARADTC-110S, KAYARADR-128H, KAYARADR-526, KAYARADNPGDA, KAYARADPEG400DA, KAYARADMANDA, KAYARADR-167, KAYARADHX-220, KAYARADHX-620, KAYARADR-551, KAYARADR-712, KAYARADR-604, KAYARADR-684, KAYARADGPO, KAYARADTMPTA, KAYARADTHE-330, KAYARADTPA-320, KAYARADTPA-330, KAYARADPET-30, KAYARADRP-1040, KAYARADT-1420, KAYARADDPHA, KAYARADDPHA-2C, KAYARADD-310, KAYARADD-330, KAYARADDPCA-20, KAYARADDPCA-30, KAYARADDPCA-60, KAYARADDPCA-120, KAYARADDN-0075, KAYARADDN-2475, KAYAMERPM-2, KAYAMERPM-21, KS series HDDA, TPGDA, TMPTA, SR series 256, 257, 285, 335, 339A, 395, 440, 495, 504, 111, 212, 213, 230, 259, 268, 272, 344, 349, 601, 602, 610, 9,003, 368, 415, 444, 454, 492, 499, 502, 9,020, 9,035, 295, 355, 208, 242, 313, 604, 205, 206, 209, 210, 214, 248, 252, 297, 348, 365C, 480, 9,036, 350 (manufactured by NIPPON KAYAKU Co., LTD.), and beam set 770 (manufactured by ARAKAWA CHEMICAL INDUSTRIES, LTD.).

The radical polymerizable monomers can be used individually or in combinations. The above noted radical polymerizable monomers are all good for wettability to a recording medium, and good for adhesion of various recording medium materials over a wide range.

Further, the inkjet inks preferably comprise water and a solvent, because this keeps the ink viscosity low and the printing speed fast. The solvent is not particularly limited, so long as the solvent dissolves the ink components well and evaporates fast after printing. Preferred solvents are ketones and/or alcohols.

Examples of suitable solvents include, but are not limited to, acetone, methyl ethyl ketone, methyl isobutyl ketone, methanol, ethanol, isopropanol, and the like. The solvents can be used individually or in combinations. Preferably, the solvent further includes water.

Examples of suitable photoinitiators include, but are not limited to, benzoin ethers, acetophenones, benzophenones, and thioxanthones. Additionally, there are special groups such as an acyl phosphine oxide, a methylphenyl glyoxylate, but benzoin alkyl ether, benzilmethylketal, hydroxy cyclohexyl phenyl ketone, p-isopropyl-α-hydroxy isobutyl phenone, 1,1-dichloroacetophenone, 2-chlorothioxanthone are preferably used. The photoinitiator is preferably used in an amount of 0.01% by mass, relative to the total amount of composition.

Examples of suitable photoinitiator assistant agents include, but are not limited to, triethanolamine, 2-dimethyl ethyl aminobenzoic acid, 4-dimethylamino benzoic acid isoamyl, and polymerizable tert-amines.

Preferred commercially available photoinitiator assistant agents include, but are not limited to, Vicure 10, 30, 55 (manufactured by Stauffer), KAYACUREBP-100, KAYACUREBMS, KAYACUREDETX-S, KAYACURECTX, KAYACURE2-EAQ, KAYACUREDMBI, KAYACUREEPA (manufactured by Nippon Kayaku Co., Inc.), IRGACURE651, 184, 907, 369 (manufactured by Ciba-Geigy Ltd.), DAROCURE1173, 1116, 953, 2959, 2273, 1664 (manufactured by Merck & Co., Inc.).

In addition, a light curable resin which contains a photoinithiator may be used.

Pigment as colorant is desirably well dispersed in the composition and provides excellent weather resistance.

For example, suitable organic or inorganic pigments include, but are not limited to the following:

Examples of red or magenta pigments include, but are not limited to, Pigment Red 3, 5, 19, 22, 31, 38, 43, 48:1, 48:2, 48:3, 48:4, 48:5, 49:1, 53:1, 57:1, 57:2, 58:4, 63:1, 81, 81:1, 81:2, 81:3, 81:4, 88, 104, 108, 112, 122, 123, 144, 146, 149, 166, 168, 169, 170, 177, 178, 179, 184, 185, 208, 216, 226, and 257, Pigment Violet 3, 19, 23, 29, 30, 37, 50, and 88, Pigment Orange 13, 16, 20, and 36.

Examples of cyan pigments include, but are not limited to, Pigment Blue 1, 15, 15:1, 15:2, 15:3, 15:4, 15:6, 16, 17-1, 22, 27, 28, 29, 36, and 60.

Examples of green pigments include, but are not limited to, Pigment Green 7, 26, 36, and 50.

Examples of yellow pigments include, but are not limited to, Pigment Yellow 1, 3, 12, 13, 14, 17, 34, 35, 37, 55, 74, 81, 83, 93, 94, 95, 97, 108, 109, 110, 137, 138, 139, 153, 154, 155, 157, 166, 167, 168, 180, 185, and 193.

Examples of black pigments include, but are not limited to, Pigment Black 7, 28, and 26.

Examples of commercial pigments include, but are not limited to, CHROMOFINE Yellow 2080, 5900, and 5930, AF-1300, 2700L, CHROMOFINE ORANGE 3700L, and 6730, CHROMOFINE SCARLET 6750, CHROMOFINE MAGENTA 6880, 6886, 6891N, 6790, and 6887, CHROMOFINE VIOLET RE, CHROMOFINE 6820, and 6830, CHROMOFINE BLUE HS-3, 5187, 5108, 5197, 5085N, SR-5020, 5026, 5050, 4920, 4927, 4937, 4824, 4933GN-EP, 4940, 4973, 5205, 5208, 5214, 5221, and 5000P, CHROMOFINE green 2GN, 2GO, 2G-550D, 5310, 5370, and 6830, CHROMOFINE black A-1103, SEIKAFAST YELLOW 10GH, Skywarrior, 2035, 2054, 2200, 2270, 2300, 2400 (B), 2500, 2600, ZAY-260, 2700 (B), and 2770, SEIKAFAST RED 8040, C405 (F), CA120, LR-116, 1531B, 8060R, 1547, ZAW-262, 1537B, GY, 4R-4016, 3820, 3891, and ZA-215, SEIKAFAST Carmine 6B1476T-7, 1483LT, 3840, and 3870, SEIKAFAST Bordeaux 10B-430, SEIKALIGHT ROSE R40, SEIKALIGHT ROSE B800, and 7805, SEIKAFAST Maroon 460N, SEIKAFAST Orange 900, 2900, SEIKALIGHT BLUE C718, and A612, cyanine blue 4933M, 4933GN-EP, 4940, 4973 (Manufactured by Dainichi Color & Chemical Mfg. Co., Ltd.), KET Yellow 401, 402, 403, 404, 405, 406, 416, and 424, KET Orange 501, KET Red 301, 302, 303, 304, 305, 306, 307, 308, 309, 310, 336, 337, 338, and 346, KET Blue 101, 102, 103, 104, 105, 106, 111, 118, and 124, KET Green 201 (manufactured by DIC Corporation), Colortex Yellow 301, 314, 315, 316, P-624, 314, U10GN, U3GN, UNN, UA-414, and U263, Finecol Yellow T-13, and T-05, Pigment Yellow 1705, Colortex Orange 202, Colortex Red 101, 103, 115, 116, D3B, P-625, 102, H-1024, 105C, UFN, UCN, UBN, U3BN, URN, UGN, UG276, U456, U457, 105C, and USN, Colortex Maroon 601, Colortex Brown B610N, Colortex Violet 600, Pigment Red 122, Colortex Blue 516, 517, 518, 519, A818, P-908, and 510, Colortex Green 402, and 403, Colortex Black 702, and U905 (manufactured by SANYO COLOR WORKS, Ltd.), Lionol Yellow 1405G, Lionol Blue FG7330, FG7350, FG7400G, FG7405G, ES, and ESP-S (MANUFACTURED BY TOYO INK Mfg. co., Ltd.), Toner Magenta E02, Permanent Rubin F6B, Toner Yellow HG, Permanent Yellow GG-02, HOSTAPERM Blue B2G (Hoechst Industry Ltd.)), carbon black #2600, #2400, #2350, #2200, #1000, #990, #980, #970, #960, #950, #850, MCF88, #750, #650, MA600, MA7, MA8, MA11, MA100, MA100R, MA77, #52, #50, #47, #45, #45L #40, #33, #32, #30, #25, #20, #10, #5, #44, CF9, and CF9, (manufactured by Mitsubishi Chemical Corporation).

The pigment is preferably present in an amount of from 1 part by mass to 20 parts by mass, based on 100 parts by mass of the ink composition. When the amount of the pigment is less than 1 part by mass, there is a resulting decrease in quality of the image. When the amount of the pigment is more than 20 by mass, there is a detrimental effect on ink viscosity.

Further, two or more colorants may be mixed to use in the ink, if necessary.

Further, the ink composition can optionally contain one or more of sensitizers, light stabilizers, surface treatment agents, surfactants, viscosity decreasing agents, antioxidants, anti-aging agents, crosslinking promotion agents, polymerization inhibitors, plasticizers, antiseptic pH adjusters, antifoamers, moisturizing agents, dispersants, and dyes.

Various crushing apparatus or various dispersing apparatus may be used to mix and disperse the above colorants and other components, with a bead mill and homogenizer being preferred.

The source of ultraviolet radiation may be any suitable source, with low pressure mercury lamps, high pressure mercury lamps, metal halide lamps, hot cathode tubes, cool cathode tubes, and LEDs being preferred.

When an ultraviolet irradiation lamp is used for curing, heat is generated, and the recording medium can undergo deformation. Therefore, cooling equipment is preferably used in such situations, such as cold mirrors, cold filters, and other coolers.

In the image forming apparatus of this invention, a source of light is necessary which includes at least two wavelengths, with one being for only curing the colorant ink, while not curing the pre-treatment agent, and the other being for curing at least the pre-treatment agent. In particular, a light resource having a narrow wavelength range is preferred, which will efficiently cure only the colored inkjet ink.

As the LED light resource for the present invention, one having an emission wavelength from 200 to 420 nm is preferably used. Considering cost and output intensity, an ultraviolet and/or visible LED having an emission wavelength of 350 to 420 nm is more preferably used.

Examples of suitable LEDs (a light-emitting diode) include, but are not limited to, UJ20 (peak wavelength: 365 nm and 385 nm, the intensity of illumination: maximum 8 $W/cm^2$, manufactured by Panasonic Electric Works Co.), UD80 (Line type) (peak wavelength: 385 nm, the intensity of illumination: 4 $W/cm^2$, manufactured by Panasonic Electric Works Co.), LEDZero (peak wavelength: 395 nm, the intensity of illumination: 1 to 2.5 $W/cm^2$, manufactured by INTEGRATION INC.), and the like.

Further, metal halide lamps can be efficient light sources for curing the pre-treatment agent, because metal halide lamps have a wide range of emitted wavelengths. In the metal halide lamps, preferred metal halide compounds include Pb, Sn, and Fe, and the like, and are selected according to the absorption spectrum of the photoinitiator.

The image forming apparatus of the present invention is equipped with a light source which will cure only the colorant inkjet ink, and cannot cure the pre-treatment agent. This light source is located adjacent the inkjet head. Therefore, an LED light, which is small and light, is preferred.

However, high powered LED light sources are few. Accordingly, the need for many LED sources to accommodate for the needed increase in illumination power, results in a higher cost.

If the range of emission wavelengths of the light source results In curing of both the pre-treatment agent and the inkjet ink, this results in a problem that the first color ink is insufficiently cured. Generally, using inefficient irradiated energy to cure, only the surface is cured, while leaving the inside incompletely cured.

An LED light source is very fit for the light source which only cures the color inkjet ink, and can not cure the pre-treatment agent, providing a particular efficiency for small apparatus.

In another embodiment, a light resource having a wide range of emission wavelengths, such as a high pressure mercury lamp or metal halide lamp, can be used, with the wavelength being adjusted using a filter.

For example, as shown in FIGS. 4A to 4E, when a high pressure mercury lamp or metal halide lamp is used with a short wavelength cut filter (for example ASAHE BUNNKOU CORPNENTO) to eliminate the wavelengths of 350 nm and less, the resulting light will only cure the color inkjet ink, and does not cure the pre-treatment agent.

Figure 4A:
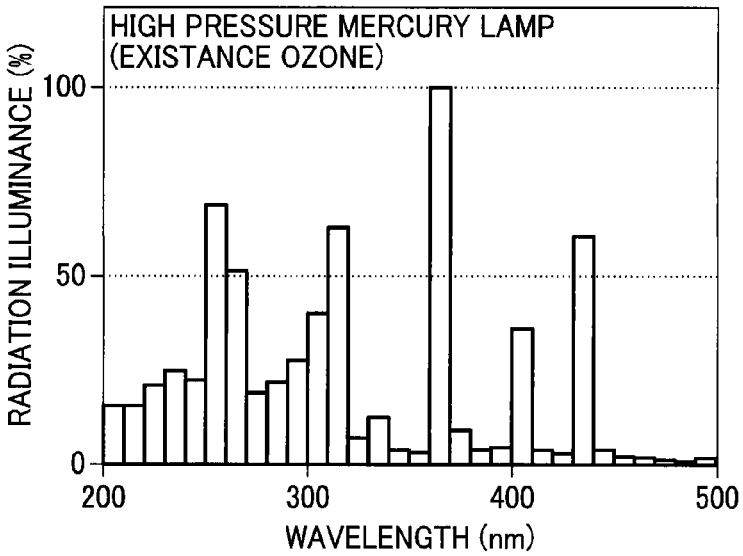
FIG. 4A is a graph showing the irradiation intensity of each output wavelength of a high pressure mercury lamp.
Figure 4B:
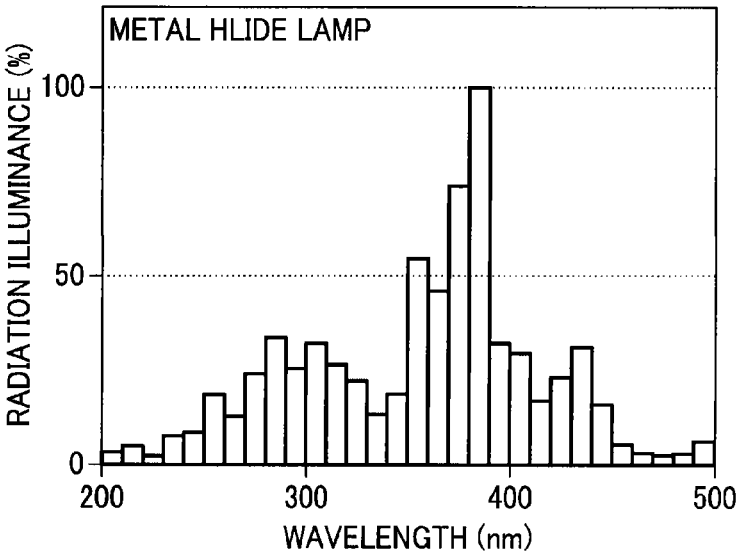
FIG. 4B is a graph showing the irradiation intensity of each output wavelength of a metal halide lamp.

FIGS. 4A and 4B are graphs, showing the irradiation intensity at given wavelengths of the high pressure mercury lamp and the metal halide lamp, respectively.

Figure 4C:
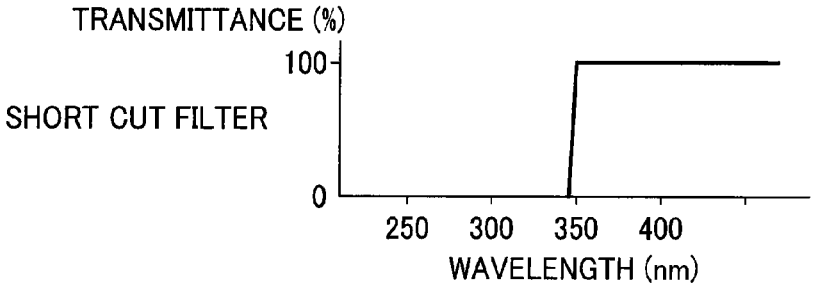
FIG. 4C is a graph showing the transmittance characteristics of a short wavelength cut filter.

Further, FIG. 4C is a graph, showing the property of a short wavelength cut filter, which eliminates the wavelengths of 350 nm and less (transmittance is 0%).

Figure 4D:
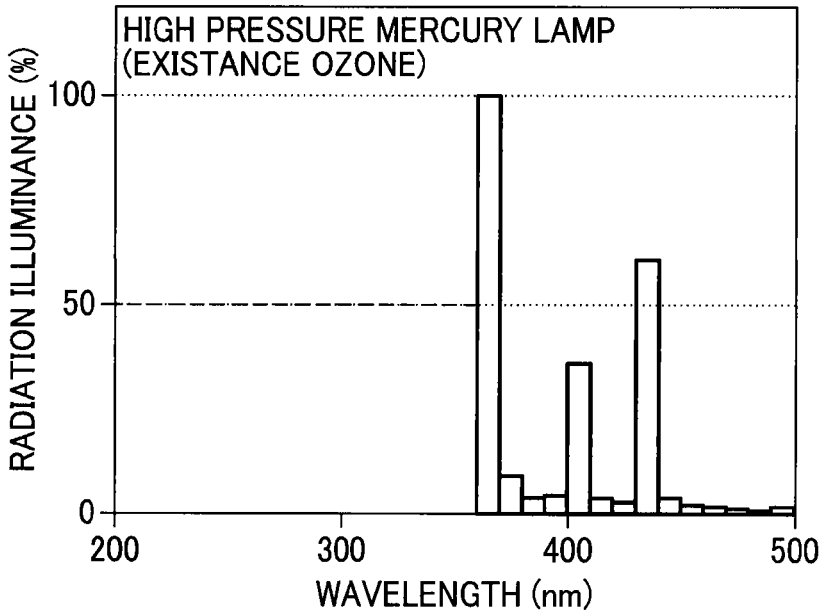
FIG. 4D is a graph showing the irradiation intensity according to wavelength when a short wavelength cut filter was applied to a high pressure mercury lamp.
Figure 4E:
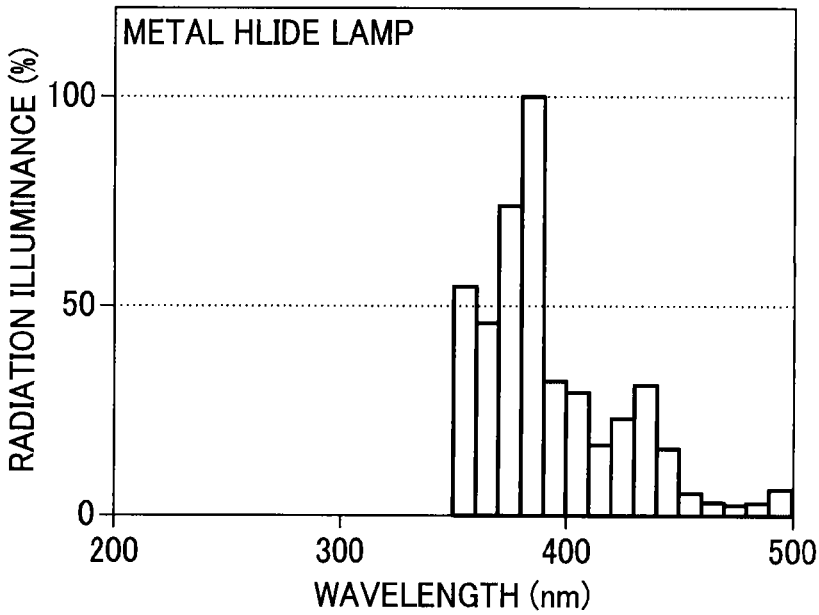
FIG. 4E is a graph showing the irradiation intensity according to wavelength when a short wavelength cut filter was applied to a metal halide lamp.

Further, FIG. 4D and FIG. 4E are graphs, showing the irradiation intensity at given wavelengths using the short wavelength cut filter shown in FIG. 4C, of the high pressure mercury lamp and the metal halide lamp showing in FIGS. 4A and 4B, respectively, where the wavelengths of 350 nm and less have been effectively eliminated by the filter.

Figure 5:
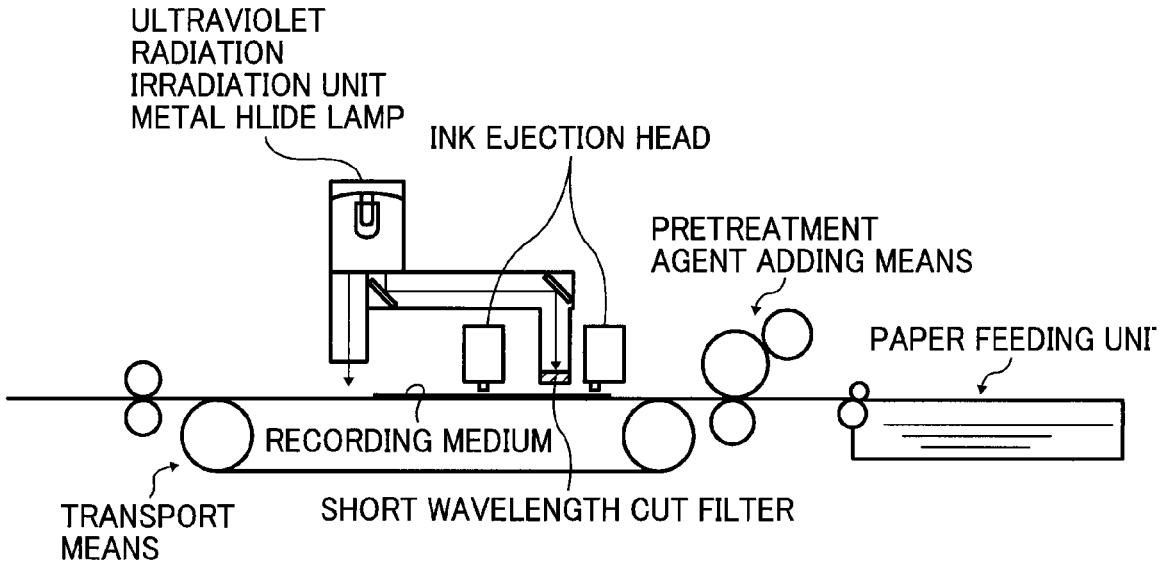
FIG. 5 is a schematic view showing one embodiment of an image recording method of the present invention, dividing a single light source, and using an optics filter if necessary.
Figure 6:
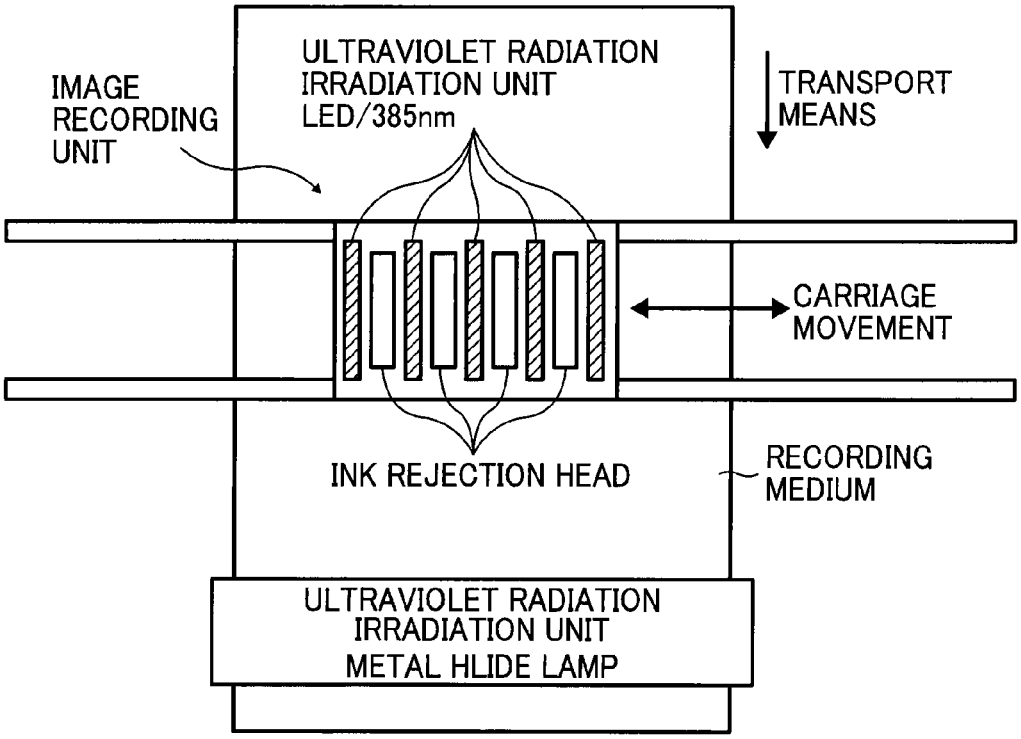
FIG. 6 is a schematic top view showing one embodiment of an image recording apparatus of the present invention.

Further, as shown in FIG. 5, a single light source can be split, and, if desired, using a short wavelength filter, generate different emission wavelengths without increasing the number of light sources.

Ink charging equipment is typically prepared with plural nozzles arranged in a line and having an ink reservoir corresponding with the ink nozzles, and may discharge by changing a volume of the respective ink reservoir by use of an actuator.

An inkjet charging head can be of any desired type, with an inkjet linehead nozzle and an inkjet serial head being two preferred types. A desired number of linehead nozzles is preferably arranged with the linehead being transverse to the direction of travel of the recording medium. The inkjet serial head operates by scanning back and forth across the recording medium as it discharges ink, with the scanning direction being transverse to the direction that the recording medium is being conveyed. The recording medium will stop briefly as each scan across its width is completed.

When using the linehead type nozzle, the convey route of the recording medium is decided by the paper feeding unit, with the type of recording medium being selected based on the absorbance property of the recording medium to the inkjet ink being used.

Further, when using an inkjet serial head, the recording medium should have high ink absorption property, the ink is charged to an intermediate transfer medium, and the ink increases viscosity before transfer to the recording medium, thus preventing excess ink absorption into recording medium, in order to obtain the required high quality.

The image forming apparatus of the above mentioned FIG. 2 uses a linehead nozzle construction, and the head is arranged such that the width of the nozzle corresponds to the width of the recording medium.

Preferably the entire surface of the recording medium is coated with a white pre-treatment agent which contains a light curing material by the use of a unit for adding the pre-treatment agent.

Further, after the ink is charged according to the image signal from the ink charge head, the ink is then cured by the preferred LED light source (385 nm) having a wavelength that will cure only the colored inkjet ink, and will not cure the pre-treatment agent.

In the linehead type nozzle embodiment, after each ink is charged and cured (typically the four colors of yellow, magenta, cyan, and black inks), a final cure is preferably performed using a high pressure mercury lamp which will cure the pre-treatment agent, and complete curing of the inkjet inks if necessary, thus providing the final colored image on the recording medium.

As noted above, by keeping the time from charging to curing the same, it is possible to prevent the excessive extension of ink drops in the pre-treatment layer, such that the ink drops form similar size pixels, and a high quality image is obtained.

FIG. 1 is a schematic view showing one example of an image recording apparatus of the present invention from the top. In this embodiment, the recording medium is fed from a paper feeding apparatus (not shown), after which the pre-treatment agent is coated on the surface, and the coated recording medium is conveyed to the image forming unit. In the image forming unit, the necessary number of ultraviolet irradiation sources (preferably LED light sources) are configured on the carriage in parallel.

The carriage then crosses back and forth across the convey direction (width direction), and charges the color inkjet ink according to the received image signal, and forms the image. The thus charged ink is cured by the ultraviolet irradiation source set adjacently to the discharge head. Once the full image is formed on the recording medium, the pre-treatment agent is cured preferably by metal halide lamp which irradiates ultraviolet irradiation, to cure the pre-treatment agent. This metal halide lamp is placed after the final ink discharge and ink curing location along the convey direction. In a preferred embodiment, when the ink is charged to the recording medium in both directions (i.e. during go and return time of the inkjet head carriage), an LED light source is set on each side of the inkjet charge head, to provide curing of the just discharged ink immediately after discharge to the recording medium, in each direction.

Further, the recording medium preferably does not move in the convey direction during movement of the ink carriage across the width direction. The recording medium only moves intermittently between the back and forth scans of the inkjet head.

Therefore, the lamp that cures the pre-treatment agent at the downstream part of the convey direction, does not need to irradiate while the recording medium is undergoing the intermittent stops, but only after all ink has been applied, and the recording medium is being transported away from the ink discharge area. Continuous irradiation by the final lamp during intermittent stopping of the recording medium can cause heat damage to the recording medium. Thus, the lamp is preferably only irradiating the recording medium during conveying of the recording medium.

Further, it is preferred not to irradiate during image forming time, and only to irradiate after all the surface is finished with the image forming, at which point the recording medium may be conveyed back to the point of irradiation.

Similarly, in the addition of the pre-treatment agent, it is preferred to cover the entire surface of recording medium with the pre-treatment agent without intermittent stopping, then if necessary convey the coated recording medium back to the point needed to begin image printing. Thus, a preferred embodiment involves continuous movement of the recording medium while applying the pre-treatment agent, followed by repositioning of the coated recording medium to the location to begin image formation, intermittent movement during image formation as each ink or carriage pass discharge of ink is performed and cured, after which the recording medium can be further repositioned for continuous passage through the final irradiation source for curing of the pre-treatment agent.

Therefore, when using a roller for adding of the pre-treatment agent, the construction needs to be separable from the recording medium.

When using an image forming apparatus having an inkjet serial head, which moves back and forth across the width of the recording medium as noted above, the conventional methods wait and cure the ink and pre-treatment agent all at once, which results in a difference among the formed dots due to differences in time between discharge of each ink and its curing. However, the image forming apparatus and image forming method of the present invention makes the time between charging of each ink and curing of the charged ink essentially the same, results in a prevention of excessive extension of ink drops in the pre-treatment layer, forming dots with the same scale of pixel, and resulting in the desired high quality image.

EXAMPLES

The present invention will be more specifically explained in the following examples, which are merely exemplary in nature and should not be construed as to limit the scope of the present invention. All parts are by mass unless otherwise specified.

Pre-treatment agent A-1 to A-5, and ink B-1 were prepared as follows.

Pre-Treatment Agent A-1

The following materials were mixed and stirred to prepare light curable material liquid A-1.

| | |
|---|---|
| Tetramethylol methane tetraacrylate polyethoxy (NK ester ATM35E, manufactured by Shin-Nakamura Chemical Co., LTD.) | 100 parts |
| photoinitiator (manufactured by Ciba company, IRGACURE 184) | 10 parts |

Pre-Treatment Agent A-2

The following materials were mixed and stirred, to prepare light curable material liquid A-2.

| | |
|---|---|
| (2-methyl-2-ethyl-1,3-dioxolane-4-yl) methylacrylate (MEDOL-10, manufactured by OSAKA ORGANIC CHEMICAL INDUSTRY LTD.) | 70 parts |
| HYPER BRANCHED POLYMER (manufactured by OSAKA ORGANIC CHEMICAL INDUSTRY LTD, VISCOAT # 1000) | 30 parts |
| photoinitiator (manufactured by Ciba company, IRGACURE 127) | 10 parts |

Pre-Treatment Agent A-3

The following materials were mixed and stirred, to prepare light curable material liquid A-3.

| | |
|---|---|
| (2-methyl-2-ethyl-1,3-dioxolane-4-yl) methylacrylate (MEDOL-10, manufactured by OSAKA ORGANIC CHEMICAL INDUSTRY LTD.) | 70 parts |

-continued

| | |
|---|---|
| HYPER BRANCHED POLYMER (manufactured by OSAKA ORGANIC CHEMICAL INDUSTRY LTD, VISCOAT# 1000) | 30 parts |
| photoinitiator (manufactured by Ciba company, IRGACURE 907) | 10 parts |

Pre-Treatment Agent A-4

The following materials were mixed and stirred, to prepare light curable material liquid A-4.

| | |
|---|---|
| tetramethylol methane tetraacrylate polyethoxy (a brand name,:, NK ester ATM35E, manufactured by Shin-Nakamura Chemical Co., LTD.) | 100 parts |
| photoinitiator (manufactured by Ciba company, DAROCURE TPO) | 10 parts |

Pre-Treatment Agent A-5

The following materials were mixed and stirred, to prepare light curable material liquid A-5.

| | |
|---|---|
| (2-methyl-2-ethyl-1,3-dioxolane-4-yl) methylacrylate (MEDOL-10, manufactured by OSAKA ORGANIC CHEMICAL INDUSTRY LTD.) | 70 parts |
| HYPER BRANCHED POLYMER (manufactured by OSAKA ORGANIC CHEMICAL INDUSTRY LTD., VISCOAT# 1000) | 30 parts |
| photoinitiator (manufactured by Ciba company, IRGACURE379) | 10 parts |

Ink B-1

The following materials were mixed and stirred, to prepare light curable material liquid B-1.

| | |
|---|---|
| Low molecule monomer acrylate A(propoxy(2)neo-pentyl glycol diacrylate) manufactured by Sartomer company SR9003) | 50 parts |
| Tripropylene glycol diacrylate B (manufactured by nippon kayaku Co., Inc., KAYARAD TPGDA) | 50 parts |
| other additive small quantities | |
| photoinitiator (product made in Ciba company, IRGACURE379) | 10 parts |
| Color materials (carbon black:) | |
| Carbon Black manufactured by Mitsubishi Chemical Co. MA-7) | 5 parts |

Examples and Comparative Examples

Ink dot image was formed by the following method using the pre-treatment agent and ink mentioned above.

The pre-treatment agent was coated on polyethylene terephthalate (PET) film (manufactured by Toray Industries. Inc. Lumirror E 20 thickness 100 μm) using MATSUO SANGYO Co., LTD. Select-Roller (OSP-02) to form a thin layer having a thickness of 2 μm.

Figure 7:
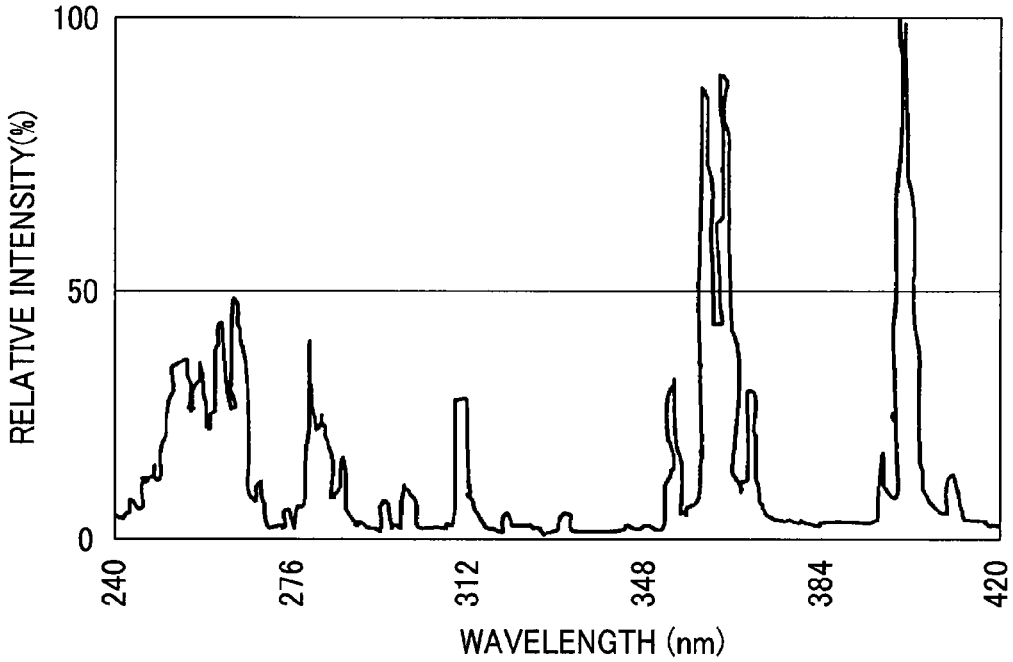
FIG. 7 is a graph showing the luminescent pattern of a bulb.

Subsequently, using an inkjet recording apparatus having a Ricoh printing system Gen4head, and regulating the temperature and wave shape for the ink of 8 pL at 8 m/s, charging three times every one second, and after every charge, ultraviolet irradiation was irradiated from a light source (manufactured by Panasonic Electric Works Co., Ltd. UJ20 (peak of wavelength 385 nm)) to cure only the ink immediately after its charge, and finally, ultraviolet irradiation was irradiated from a light source (manufactured by Integration Technology 社製 SubZero 085 ABulb) to cure the pre-treatment agent, as well as complete any curing of the ink. The emission spectrum of the ABulb is shown in FIG. 7.

As a Comparative Example, the same process was performed with the exception that the UJ20 light source was turned off, with the only cure being performed by the final irradiation with the ABulb. (see last cure of Table 1).

The absorption property of each initiator used is shown in FIGS. 8A to 8E.

Figure 8A:
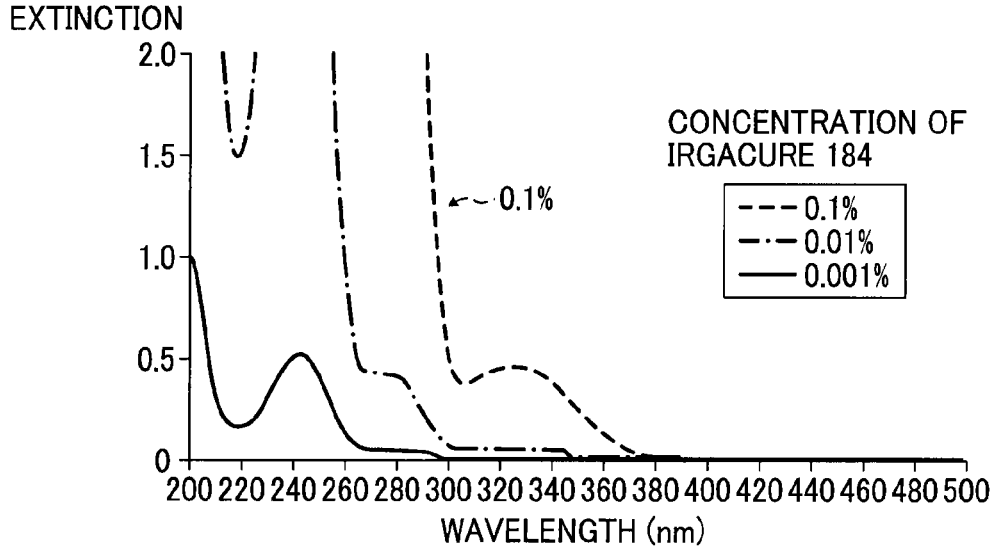
FIG. 8A is a graph showing absorption characteristics of IRGACURE 184 (manufactured by Ciba-Geigy Ltd.).
Figure 8B:
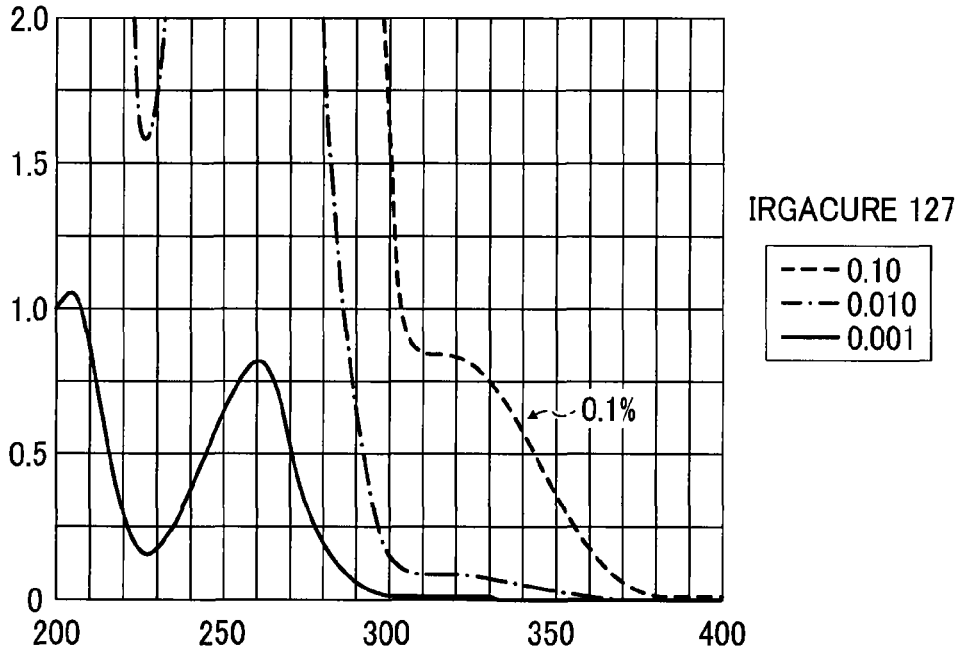
FIG. 8B is a graph showing absorption characteristics of IRGACURE 127 (manufactured by Ciba-Geigy Ltd.).
Figure 8C:
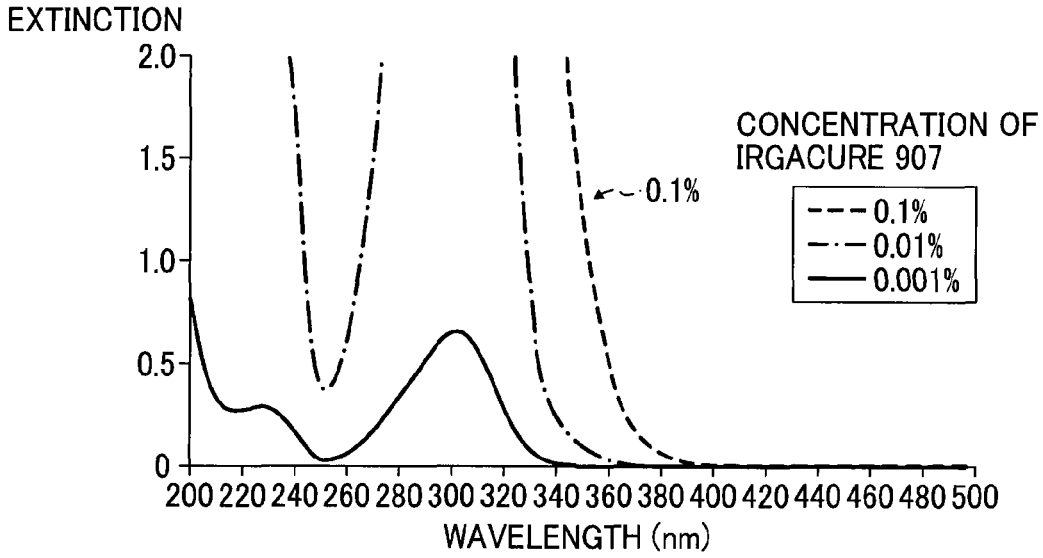
FIG. 8C is a graph showing absorption characteristics of IRGACURE 907 (manufactured by Ciba-Geigy Ltd.).
Figure 8D:
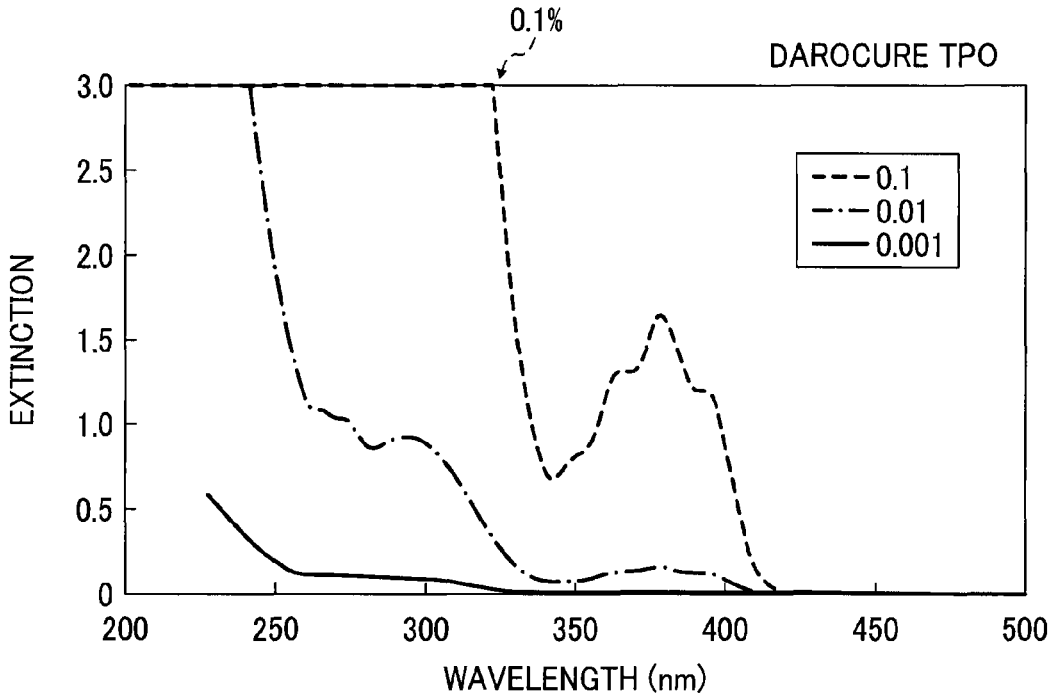
FIG. 8D is a graph showing absorption characteristics of DAROCURE TPO (manufactured by Ciba-Geigy Ltd.).
Figure 8E:
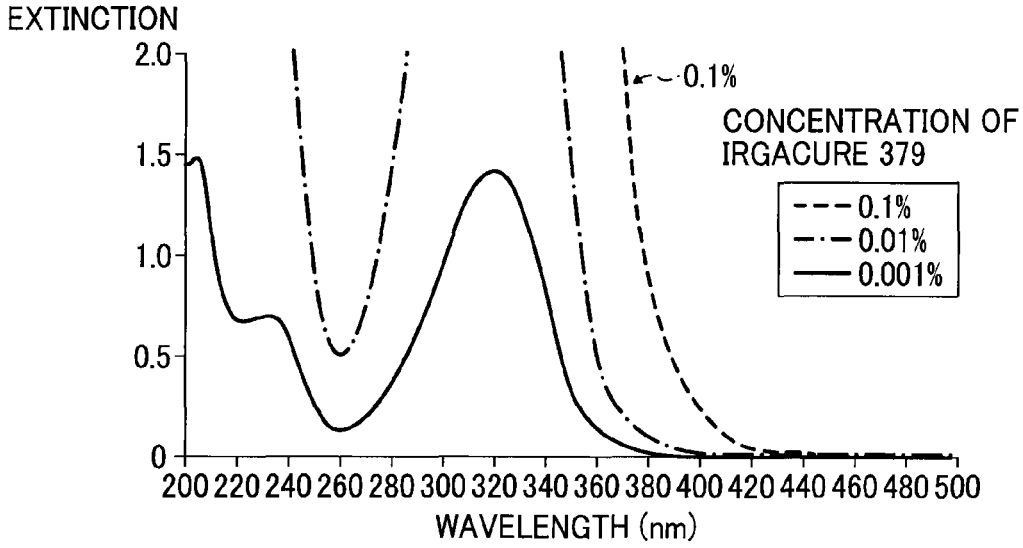
FIG. 8E is a graph showing absorption characteristics of IRGACURE 379 (manufactured by Ciba-Geigy Ltd.).

FIG. 8A is IRGACURE 184, FIG. 8B is IRGACURE 127, FIG. 8C is IRGACURE 907, FIG. 8D is DAROCURE TPO, and FIG. 8E is IRGACURE 379.

Further, the dot diameter of the formed ink dot image was measured. Measurement of dot diameter was performed using a KEYENCE CORPORATION microscope VHX-200. The results are reported as follows:

Where the dot diameter was 75±μm=[○]

Where the dot diameter is not 75±μm=[X].

The results are shown in Table 1.

TABLE 1

| Pre-treatment agent | Method of Curing | First | Second | Third |
|---|---|---|---|---|
| A-1 | Curing after each ink charged | ○ | ○ | ○ |
| A-2 | Curing after each ink charged | ○ | ○ | ○ |
| A-3 | Curing after each ink charged | ○ | ○ | ○ |
| A-4 | Curing after each ink charged | ○ | X: Pre-treatment agent layer was cured | X: Pre-treatment agent layer was cured |
| A-5 | Curing after each ink charged | ○ | X: Pre-treatment agent layer was cured | X: Pre-treatment agent layer was cured |
| A-1 | One curing after all ink was charged | X | X | ○ |
| A-5 | One curing after all ink was charged | X | X | ○ |

As can be understood from Table 1, in the case of the present invention method that cures immediately after each ink charge, each of pre-treatment agents A-1, A-2, and A-3 using an initiator which does not have absorption property at wavelength area (385 nm) of ultraviolet as curing means, then only ink was cured and the printed dot diameter of each ink charge was essentially equal.

Meanwhile, in the case of using pre-treatment agents A-4, and A-5 using an initiator having an absorption property at wavelength area (385 nm) of ultraviolet as curing means, where the pre-treatment agent was cured before the second and third ink charging, the dot diameters were too varied in diameter.

Further, when ink and pre-treatment were cured together only after all ink was charged, in the case of pre-treatment agents A-1 and A-5, the dot diameter of ink drops was too large.

Thus, the present invention apparatus and method provides significantly more uniform pixel diameter in recorded images.

Obviously, additional modifications and variations of the present invention are possible in light of the above teachings. It is therefore to be understood that within the scope of the appended claims, the invention may be practiced otherwise than as specifically described herein.

The invention claimed is:

1. An image recording method, comprising:

(i) adding a curable pre-treatment agent comprising a curable non-colored material to a surface of a recording medium, (ii) discharging at least one curable inkjet ink to the surface of the recording medium to form an image, (iii) curing the at least one curable inkjet ink by irradiation with at least one light irradiation unit at a wavelength that cures the at least one curable inkjet ink but does not cure the curable pre-treatment agent; and (iv) curing the curable pre-treatment agent by irradiation with a light irradiation unit at a wavelength that cures the curable pre-treatment agent, wherein steps (ii) and (iii) are performed, followed by step (iv), and wherein steps (ii) and (iii) may be performed a plurality of times prior to proceeding to step (iv).

2. The image recording method of claim 1, wherein said curable pre-treatment agent is discharged to an image forming area on the surface of the recording medium.

3. The image recording method of claim 2, wherein said curable pre-treatment agent is discharged to the entire surface of the recording medium.

4. The image recording method of claim 1, wherein a plurality of curable inkjet inks are used, and wherein steps (ii) and (iii) are sequentially performed for each of said plurality of curable inkjet inks.

5. The image recording method of claim 4, wherein the recording medium intermittently stops during each sequential performance of steps (ii) and (iii), and moves to a new ink discharge location between each sequential performance of steps (ii) and (iii).

6. The image recording method of claim 1, wherein the recording medium is continuously conveyed during the adding of the curable pre-treatment agent to the surface thereof.

7. The image recording method of claim 1, wherein the recording medium comes to a stop during steps (ii) and (iii).

8. The image recording method of claim 1, wherein the recording medium is continuously conveyed during step (iv).

* * * * *